US009528253B2

(12) United States Patent
Huang

(10) Patent No.: US 9,528,253 B2
(45) Date of Patent: Dec. 27, 2016

(54) CONTROLLER ASSEMBLY FOR AUTOMATIC FLUSH VALVE

(71) Applicant: FLUSHTECH CORPORATION, Taoyuan (TW)

(72) Inventor: Bin-Han Huang, Taipei (TW)

(73) Assignee: Flushtech Corporation, Luju, Taoyuan (TW)

( * ) Notice: Subject to any disclaimer, the term of this patent is extended or adjusted under 35 U.S.C. 154(b) by 376 days.

(21) Appl. No.: 14/456,027

(22) Filed: Aug. 11, 2014

(65) Prior Publication Data

US 2016/0017584 A1 Jan. 21, 2016

(30) Foreign Application Priority Data

Jul. 17, 2014 (TW) ..... 103212780 U

(51) Int. Cl.

| | |
|---|---|
| ***E03D 1/00*** | (2006.01) |
| ***E03D 5/10*** | (2006.01) |
| ***E03D 3/02*** | (2006.01) |
| ***E03D 3/06*** | (2006.01) |

(52) U.S. Cl.

CPC ..... *E03D 5/105* (2013.01); *E03D 3/02* (2013.01); *E03D 3/06* (2013.01)

(58) Field of Classification Search

CPC ..... E03D 5/105; E03D 3/02; E03D 3/06
USPC ..... 4/313
See application file for complete search history.

(56) References Cited

U.S. PATENT DOCUMENTS

| | | | | |
|---|---|---|---|---|
| 8,496,025 | B2 * | 7/2013 | Parsons | E03C 1/05 137/624.11 |
| 8,556,228 | B2 * | 10/2013 | Marcichow | E03D 3/02 251/129.04 |
| 2014/0224338 | A1 * | 8/2014 | Maercovich | E03D 3/06 137/1 |
| 2015/0013058 | A1 * | 1/2015 | Bucher | E03D 9/035 4/378 |
| 2015/0074893 | A1 * | 3/2015 | Veros | E03D 1/00 4/313 |
| 2015/0267387 | A1 * | 9/2015 | Shinohara | E03D 5/10 4/313 |

* cited by examiner

*Primary Examiner* — Christine Skubinna
(74) *Attorney, Agent, or Firm* — Rosenberg, Klein & Lee

(57) ABSTRACT

A controller assembly for an automatic flush valve provides economical approach to transforming a manual flush valve into an automatic flush valve. The controller assembly includes a base for holding a battery set and a sensor into a combination, and a cap covering the combination. A solenoid valve and a membrane below the combination are receiving in a socket of a foundation. A ring is rotatably mounted around a bottom of the foundation. A sleeve passing the cap is mounted around the foundation and stands on the ring. The ring allows the controller assembly to be easily assembled with a valve body of any type into an automatic flush valve or to be easily removed from the automatic flush valve and replaced by a manual controller assembly so as to form a manual flush valve. Thereby, the transformation can be economical accomplished without replacing the existing valve body.

10 Claims, 4 Drawing Sheets

CONTROLLER ASSEMBLY FOR AUTOMATIC FLUSH VALVE

BACKGROUND OF THE INVENTION

1. Technical Field

The present invention relates to controllers for flush valves, and more particularly to a controller assembly for an automatic flush valve, which provides easy transformation from a manual flush valve into an automatic flush valve.

2. Description of Related Art

The existing flush valves can be roughly divided into manual ones and automatic ones, which implement different flush-activating mechanisms and in turn different valve configurations. For this reason, it is almost impossible to transform a conventional manual flush valve into an automatic flush valve. Traditionally, when a consumer who previously bought a manual flush valve wants to use automatic flushing instead, the only way to accomplish this is to replace the whole valve. In the event that the existing valve body is still usable, this causes waste of both money and resources.

SUMMARY OF THE INVENTION

For making good use of the conventional manual flush valves, the present invention provides a controller assembly for an automatic flush valve, which comprises a battery set, a sensor, a base for holding the battery set and the sensor together into a combination, a cap covering the combination from outside, and a solenoid valve as well as a membrane provided below the combination; the controller assembly being characterized in:

- A foundation, being an integral part including an upper flange, a lower flange, and a grating segment between the two flanges, and having an upward-open socket and a downward projecting pipe, wherein the socket has a bottom communicated with an upper end of the pipe, and the solenoid valve and the membrane are placed in the socket of the foundation successively from top;
- A ring, being rotatably mounted around the lower flange of the foundation; and
- A sleeve, passing the cap to be mounted around the foundation and deposited on the ring, and being affixed to the foundation by means of at least one bolt.

In the controller assembly of the foregoing preferred embodiment of the present invention, preferably, the pipe of the foundation has a lower end thereof screwed to a guiding tube that is configured to be inserted into a water inlet of a valve body. Preferably, at least one O-ring seal is provided between the guiding tube and the water inlet of the valve body. Preferably, a washer is mounted around the pipe and located between a bottom of the foundation and a top of the valve body.

In the controller assembly of the foregoing preferred embodiment of the present invention, preferably, the solenoid valve is affixed to a top of the foundation by means of a plurality of bolts.

In the controller assembly of the foregoing preferred embodiment of the present invention, preferably, the ring has inner threads for combining with a valve body.

In the controller assembly of the foregoing preferred embodiment of the present invention, preferably, a push button is provided in a receiving hole provided on the foundation and acts as a switch for manually controlling water discharging of the flush valve. Preferably, a patch such covering one side of the sleeve that the push button is exposed outside the patch. More preferably, the patch is fixed to the foundation by means of a bolt.

In the controller assembly of the foregoing preferred embodiment of the present invention, preferably, a washer is provided between the base that holds the sensor and the battery set and a top of the foundation.

The disclosed controller assembly as described above, the foundation provides a platform to integrate the battery set, the sensor, the solenoid valve and the membrane into a portable device, and when working with rings of different sizes, the device can be assembled to any valve body to form an automatic flush valve. On the other hand, the disclosed controller assembly can be easily removed from the valve body and replaced by a manual controller assembly so as to form a manual flush valve. In this manner, the present invention provides easy and convenient transformation between an automatic flush valve and a manual flush valve. This allows consumers to transform their existing flush valve in a more economical way.

The invention as well as a preferred mode of use, further objectives and advantages thereof will be best understood by reference to the following detailed description of illustrative embodiments when read in conjunction with the accompanying drawings.

DETAILED DESCRIPTION OF THE INVENTION

Figure 1:
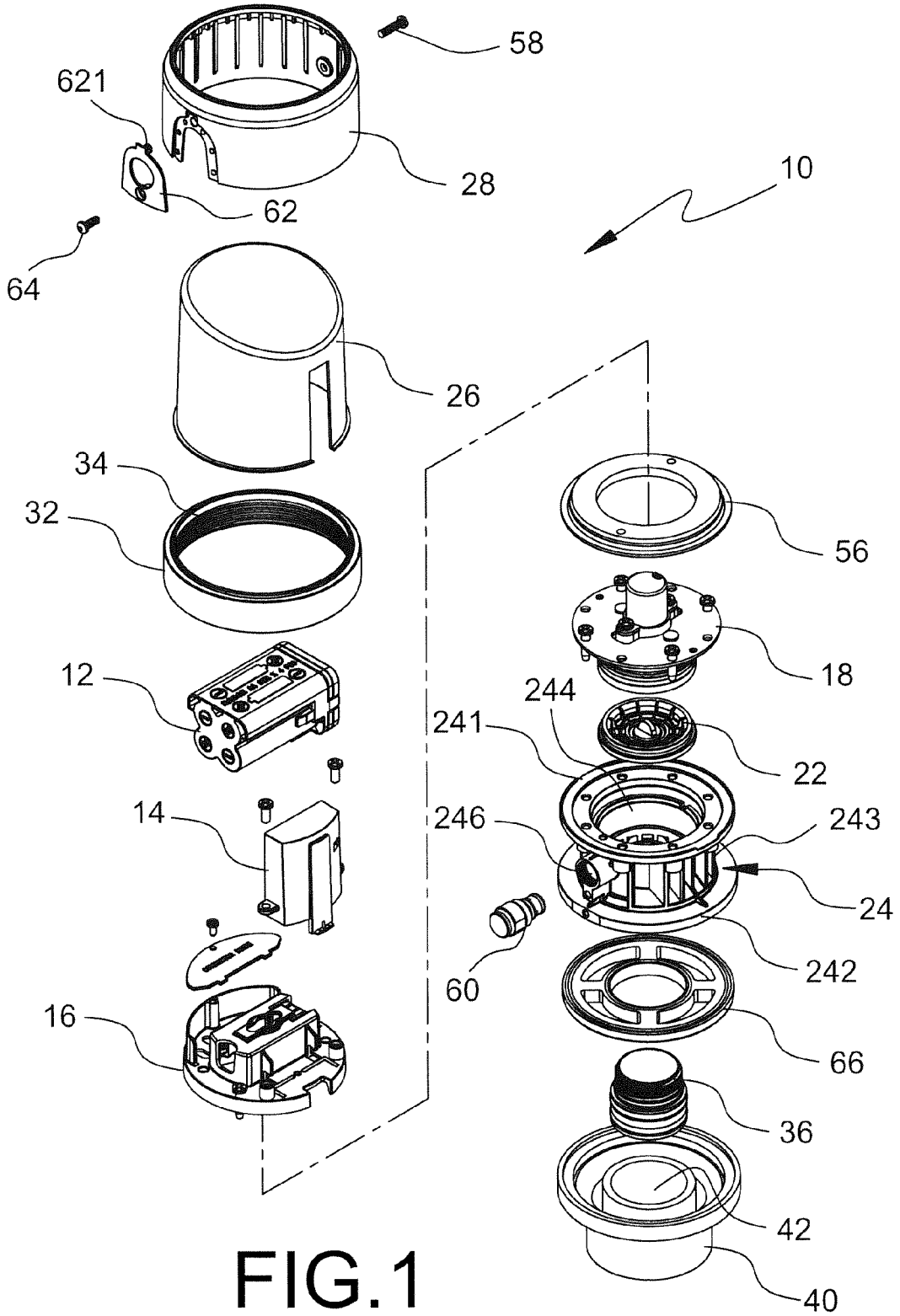
FIG. 1 is an exploded view of a controller assembly for an automatic flush valve according to the present invention.
Figure 2:
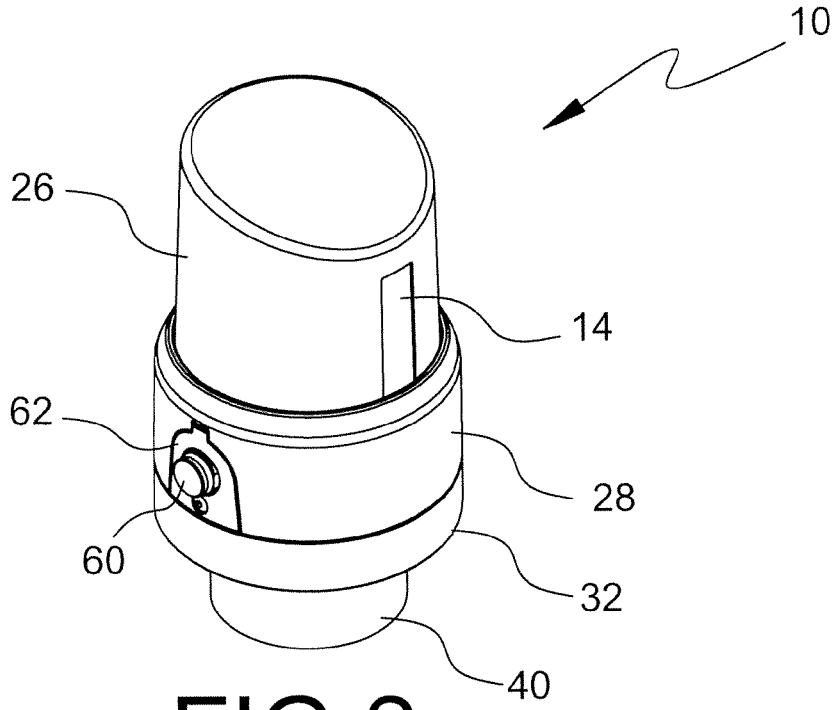
FIG. 2 is a perspective view of the controller assembly of FIG. 1.
Figure 3:
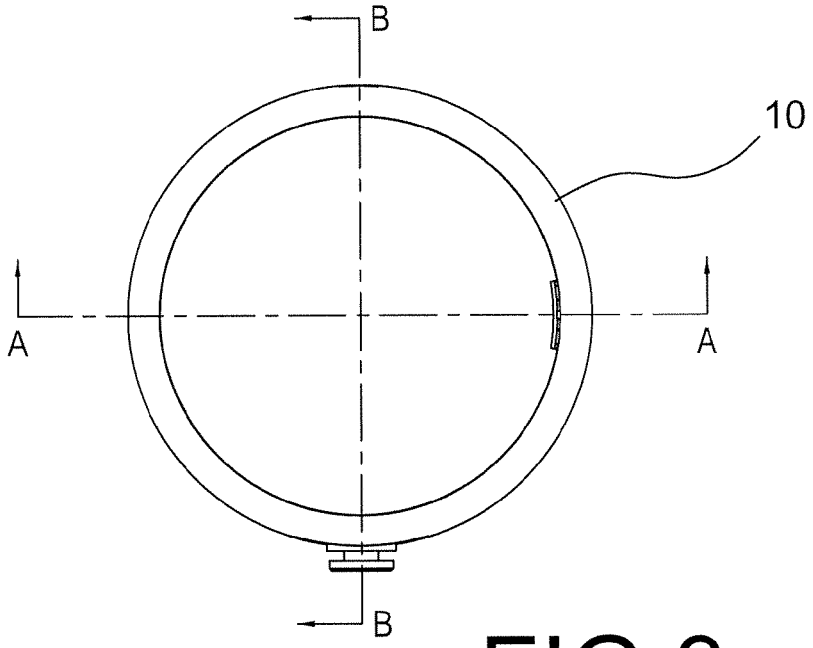
FIG. 3 is a top view of the controller assembly of FIG. 2.
Figure 4:
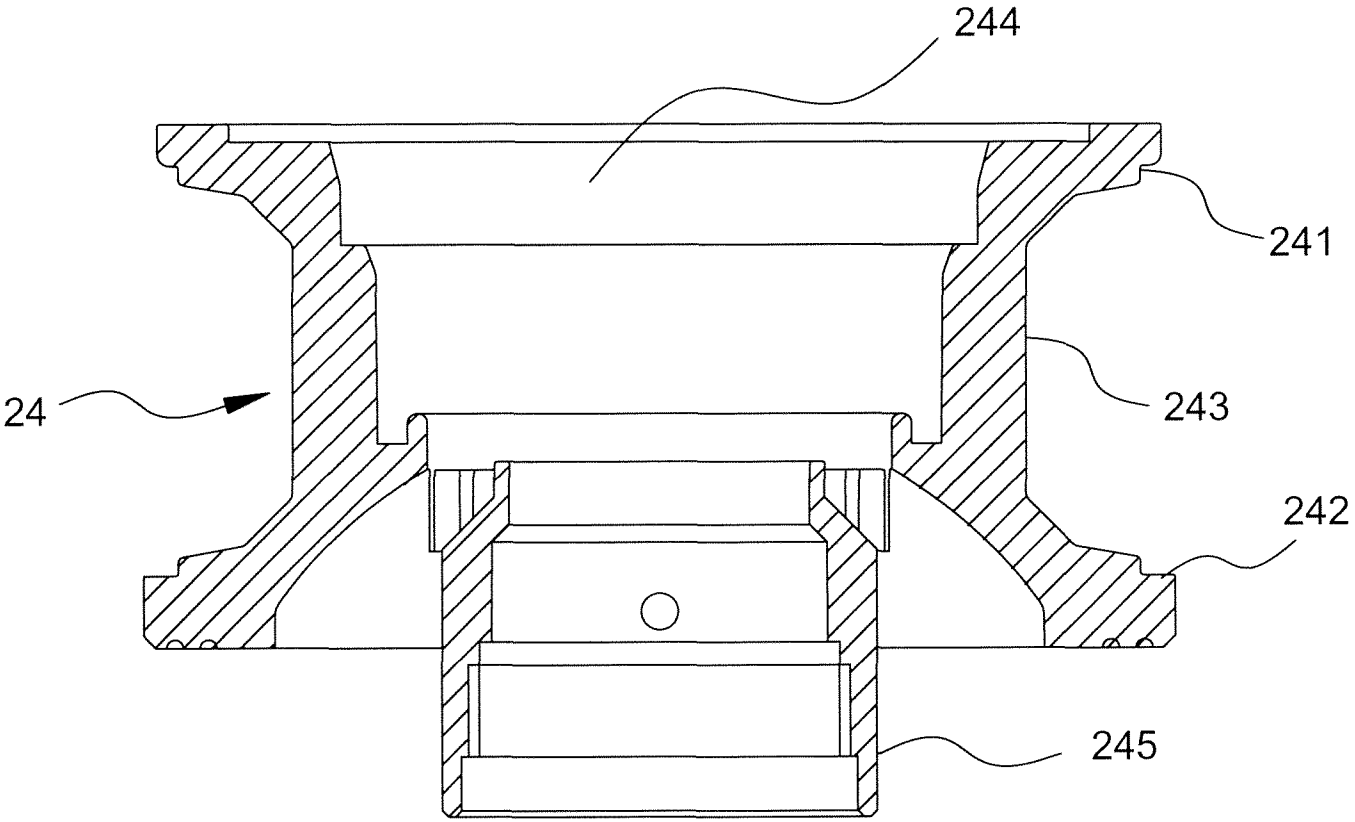
FIG. 4 is a cross-sectional view of a foundation in the controller assembly of FIG. 2.

Referring to FIGS. 1 and 2, in a preferred embodiment of the present invention, a controller assembly for an automatic flush valve 10 comprises: a battery set 12, a sensor 14 and abuse 16 holding the battery set 12 and the sensor 14 together. The automatic flush valve 10 also comprises: a solenoid valve 18, a membrane 22 and a foundation 24 for carrying the solenoid valve 18 and the membrane 22. The automatic flush valve 10 further comprises: a cap 26 covering the battery set 12 and the sensor 14 from outside, a sleeve 28 passing the cap 26 to be mounted around the solenoid valve 18 and the membrane 22, and a ring 32 provided at a bottom of the sleeve 28. The ring has inner threads 34 for engaging with a valve body 40, so as to form an automatic flush valve using inductive control (as shown in FIG. 2).

Figure 6:
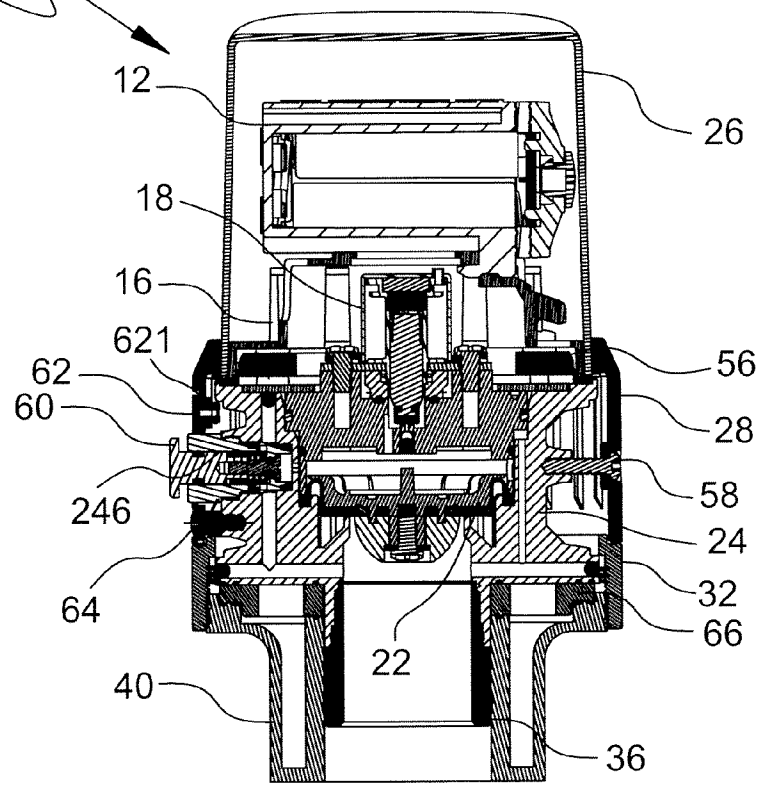
FIGS. 5 and 6 are cross-sectional views of the controller assembly taken along Line A-A and Line B-B of FIG. 3.
Figure 5:
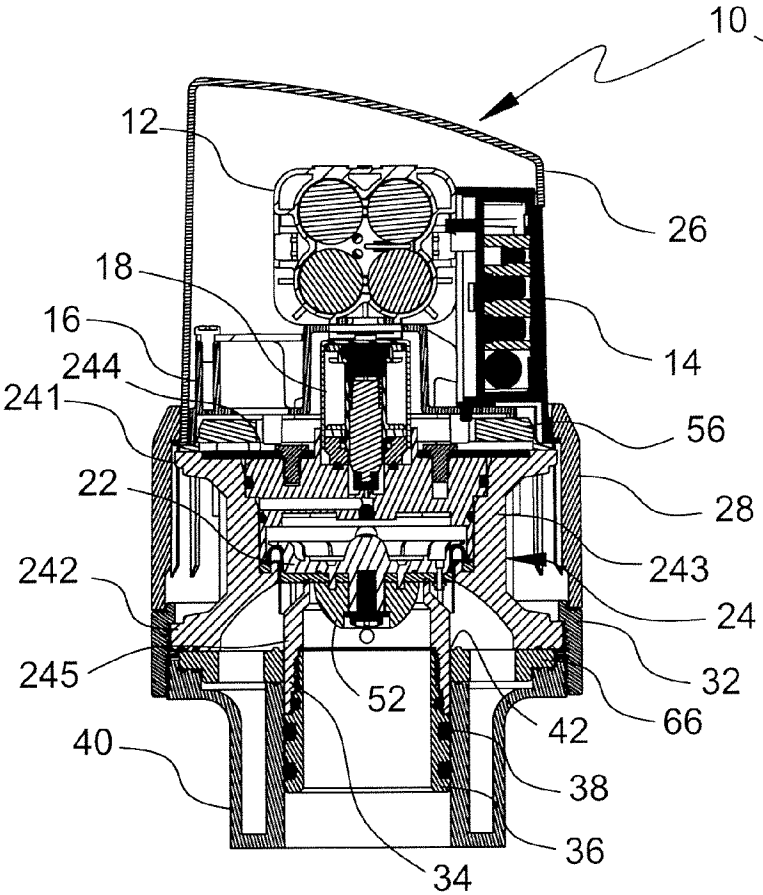

Please refer to FIG. 1 and FIGS. 4 through 6. In the controller assembly 10 of the preferred embodiment of the present invention as described above, it is primarily the foundation 24 that holds all the components together. The foundation 24 is an integral part having an upper flange 241, a lower flange 242, and a grating segment 243 between the two flanges 241, 242. The foundation 24 also has an upward-open socket 244 and a downward projecting pipe 245. The bottom of the socket 244 is communicated with the upper end of the pipe 245 so as to form a water channel. Additionally, the lower end of pipe 245 is configured to be screwed to a guiding tube 36. An O-ring seal 38 is mounted around and together with the guiding tube inserted into a water inlet 42 of the valve body 40 (as shown in FIGS. 5 and 6).

As shown in FIGS. 5 and 6, the membrane 22 is deposited at the bottom of the socket 244 in the foundation 24 and is equipped with a counterweight nut 52. The solenoid valve 18 on the membrane 22 is also accommodated in the foundation 24 and is fixed to the top of the foundation 24 by means of a plurality of bolt (not shown). The battery set 12 and the sensor 14 are held as a combination by the base 16. The combination is fixed to the top of the foundation 24 with a washer 56 therebetween. The cap 26 covers the battery set 12, the sensor 14 and the solenoid valve 18, and stands on the top of the foundation 24. Then, the ring 32 is rotatably mounted around the lower flange 242 of the foundation 24. At last, the sleeve 28 passes the cap 26 and is mounted around the foundation 24, with a bolt 58 affixing the sleeve 28 to the foundation 24 (as shown in FIG. 6). Furthermore, a push button 60 is provide in a receiving hole 246 of the foundation 24, for manually controlling water discharge of the flush valve. A patch 62 and a buckle 621 thereon are provided at one side of the sleeve 28, so that the push button 60 is exposed outside the patch 62 that is affixed to the foundation 24 by a bolt 64.

Referring to FIGS. 5 and 6, in the controller assembly 10 of the preferred embodiment of the present invention as described above, when the pipe 245 at the bottom of the foundation 24 is screwed to the guiding tube 36, and installed at the water inlet 42 of the valve body 40 through a washer 66, a flush valve using automatic control is formed. Water can enter the solenoid valve 18 through the grating segment 243 of the foundation 24. Then the solenoid valve controls the membrane 22 to move upward to make the opening at the upper end of the pipe 245 open. As a result, the water flushes from the pipe 245, the guiding tube 36 and the valve body 40 to a toilet (not shown).

The foundation 24 of the controller assembly 10 provides a platform to integrate the battery set 12, the sensor 14, the solenoid valve 18 and the membrane 22 into a portable device, and when working with rings 32 of different sizes, the device can be assembled to any valve body to form an automatic flush valve. On the other hand, the disclosed controller assembly 10 can be easily removed from the valve body and replaced by a manual controller assembly so as to form a manual flush valve. In this manner, the present invention provides easy and convenient transformation between an automatic flush valve and a manual flush valve.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A controller assembly for an automatic flush valve, the controller assembly comprising a battery set, a sensor, a base that holds the battery set and the sensor together into a combination, a cap covering the combination from outside, and a solenoid valve as well as a membrane provided below the combination, and the controller assembly being characterized in:

a foundation, being an integral part including an upper flange, a lower flange, and a grating segment between the two flanges, the foundation having an upward-open socket and a downward projecting pipe, wherein the socket has a bottom communicated with an upper end of the pipe, and the solenoid valve and the membrane are placed in the socket of the foundation successively from top;

a ring, being rotatably mounted around the lower flange of the foundation; and a sleeve, passing the cap to be mounted around the foundation and deposited on the ring, and being affixed to the foundation by means of at least one bolt.

2. The controller assembly of claim 1, wherein the pipe of the foundation has a lower end thereof screwed to a guiding tube that is configured to be inserted into a water inlet of a valve body.

3. The controller assembly of claim 2, further comprising at least one O-ring seal that is provided between the guiding tube and the water inlet of the valve body.

4. The controller assembly of claim 2, further comprising a washer that is mounted around the pipe and located between a bottom of the foundation and a top of the valve body.

5. The controller assembly of claim 1, wherein the solenoid valve is affixed to a top of the foundation by means of a plurality of bolts.

6. The controller assembly of claim 1, wherein the ring has inner threads for combining with a valve body.

7. The controller assembly of claim 1, further comprising a push button that is provided in a receiving hole provided on the foundation and acts as a switch for manually controlling water discharging of the flush valve.

8. The controller assembly of claim 7, further comprising a patch such covering one side of the sleeve that the push button is exposed outside the patch.

9. The controller assembly of claim 8, wherein the patch is fixed to the foundation by means of a bolt.

10. The controller assembly of claim 1, further comprising a washer provided between the base that holds the sensor and the battery set and a top of the foundation.

* * * * *